US006789863B2

(12) United States Patent
Nojima et al.

(10) Patent No.: US 6,789,863 B2
(45) Date of Patent: Sep. 14, 2004

(54) RECORDING APPARATUS AND METHOD OF CONTROLLING THE SAME

(75) Inventors: Takashi Nojima, Tokyo (JP); Osamu Sato, Kanagawa (JP); Atsuhiro Tsuchiya, Kanagawa (JP); Akio Kato, Kanagawa (JP); Masahiko Kubota, Tokyo (JP); Koichi Kuno, Tokyo (JP); Hiroyuki Tamaki, Kanagawa (JP); Taku Higashiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/990,348

(22) Filed: Nov. 23, 2001

(65) Prior Publication Data

US 2002/0063742 A1 May 30, 2002

(30) Foreign Application Priority Data

Nov. 30, 2000 (JP) ..... 2000-364956

(51) Int. Cl.[7] ..... B41J 3/00; B41J 29/393; B41J 29/38

(52) U.S. Cl. ..... 347/2; 347/19; 347/5

(58) Field of Search ..... 347/2, 19, 23, 347/5, 109, 29, 161, 144

(56) References Cited

U.S. PATENT DOCUMENTS 4,835,546 A * 5/1989 Keller ..... 346/33
6,390,595 B1 * 5/2002 Kusumi ..... 347/33

* cited by examiner

*Primary Examiner*—Stephen D. Meier
*Assistant Examiner*—An H. Do
(74) *Attorney, Agent, or Firm*—Fitzpatrick, Cella, Harper & Scinto

(57) ABSTRACT

A recording apparatus includes a recording unit for effecting recording on a recording medium, and a conveying unit for conveying the recording medium. The recording apparatus further includes a power input terminal adapted to be switched ON/OFF by the ignition key switch of an automobile, and a controller for executing the operation sequence of the recording apparatus in accordance with the ON/OFF state of the power input terminal. In addition, a method of controlling the above-described recording apparatus includes executing the operation sequence of the recording apparatus in accordance with the ON/OFF state of the power input terminal switched ON/OFF by the ignition key switch of an automobile.

18 Claims, 10 Drawing Sheets

RECORDING APPARATUS AND METHOD OF CONTROLLING THE SAME

BACKGROUND OF THE INVENTION

1. Field of the Invention

This invention relates to a method of controlling a recording apparatus, and particularly to a method of controlling a recording apparatus using an ink jet recording system.

2. Related Background Art

As recording apparatuses to be mounted on vehicles, there have heretofore been put into practical use various recording apparatuses mounted on vehicles to issue taxi fare receipts and issue slips in the transport industry. As such recording apparatuses, it is often the case that those being carried are of the thermal type using thermosensitive paper for coloring in black by being heated.

On the other hand, electronic apparatuses carried on automobiles have made remarkable advances in recent years and with the navigation system using GPS (global positioning system) as a core, they have evolved as information terminals for effecting Internet connection and highway toll collection. In such information terminals, there are provided color display apparatuses and the demand for color printing has been on the rise.

Also, ink jet recording apparatuses which can obtain inexpensive and highly definite prints have widely spread as the printing means of personal computers.

Among the above-described ink jet recording apparatuses, recording means (recording head) of the ink jet type which discharges ink by the utilization of heat energy and has a liquid path arrangement (discharge port arrangement) of high density can be easily manufactured by forming an electrothermal converting element, an electrode, a liquid path wall, a top plate, etc. in film manner on a substrate by way of semiconductor manufacturing processes such as etching, evaporation and sputtering, and enables further compactness to be achieved. Also, by making the most of the merits of the IC technique and the microprocessing technique, it becomes easy to make the recording means long and flat (two-dimensional) and the full multiplication and highly dense mounting of the recording means also become easy.

However, the ink jet recording apparatus discharges ink through a minute nozzle to thereby effect recording and therefore, the ink in the nozzle is liable to evaporate and cause clogging. In order to prevent such evaporation of the ink, it is necessary to cap a discharge surface when recording is not effected for a long time.

Also, if the ink jet recording apparatus is left unused for a long period, bubbles may collect in a common liquid chamber communicating with ink flow paths due to the relations of gases dissolved in the ink and the gas transmissivity of members constituting the head and the adhesively securing portion thereof to thereby hamper the ink supply to the nozzle.

The cap is made of an elastic material such as rubber or elastomer and has negative pressure generating means connected thereto to thereby suitably suck the ink in the nozzle and eliminate clogging.

In the ink jet recording apparatuses of the conventional type used in offices and homes, time is always monitored by an electrical timer and when a predetermined time elapses, it automatically performs the sucking operation. This timer is operated by the electric power of an AC power source.

SUMMARY OF THE INVENTION

In making the present invention, it has been tried to carry the above-described ink jet recording apparatus on an automobile or the like and use the apparatus. In this case, electric power is obtained from the battery of the automobile or the like.

However, in a case where the ink jet recording apparatus is carried on an automobile, when the power key of the recording apparatus is not depressed and the power supply is cut off by the ignition key of the automobile, there occurs such a trouble that the capping of the nozzle is not effected and the cap is clogged.

Also, if electric power is directly supplied from the battery of the automobile independently of the ignition key, the problem that the capping is not effected will be solved, but if the automobile is left unused for a long time with the power supply of the recording apparatus kept ON and with the engine of the vehicle stopped, there has sometimes arisen the problem that the electric power of the battery of the vehicle is consumed and the battery is completely discharged.

So, it is the object of the present invention to solve the problems as noted above and to provide a method of controlling the power source of a recording apparatus which minimizes the consumption of a battery, in view of circumstances peculiar to a power source carried on an automobile and environmental conditions.

In order to achieve the above object, the method of controlling a recording apparatus according to the present invention is a method of controlling a recording apparatus comprising recording means for effecting recording on a recording medium, conveying means for conveying the recording medium, and a power input terminal adapted to be switched on and off by an ignition key switch, the method comprising a step at which the operation sequence of the recording apparatus is executed in accordance with the ON/OFF state of the power input terminal.

In the method of controlling the recording apparatus according to the present invention as described above, the operation sequence of the recording apparatus is executed in accordance with the ON/OFF state of the above-mentioned power input terminal and therefore, even when, for example, the user of a recording apparatus installed in an automobile has forgotten to switch off the power source switch of the main body of the recording apparatus and has switched off only the ignition key switch, the operation sequence for maintaining the recording characteristic of the recording means and the operation sequence for terminating the operation of the recording apparatus can be executed in the OFF state of the ignition key switch.

Also, the method of controlling the recording apparatus according to the present invention may comprise the terminating operation step of executing the terminating operation sequence of the operation sequences when the electric power supply from the aforementioned power input terminal has become OFF, and the power source switching off step of switching off the electric power supply from a power input terminal after the execution of the terminating operation step.

Also, the recording means may be ink jet recording means for causing ink to fly from a nozzle to thereby effect recording. In this case, the recording apparatus has cap means for covering the nozzle of the ink jet recording means, and driving means for moving the cap means toward and away from the nozzle of the ink jet recording means, and the terminating operation sequence may include the step at which the driving means covers the nozzle of the ink jet recording means with the cap means. In this case, even if the user has forgotten to switch off the power source switch of the main body of the recording apparatus and has switched off only the ignition key switch, the electric power supply from the power input terminal is stopped after the nozzle of the ink jet recording means is covered with the cap means and therefore, it is possible to eliminate such a factor adversely affecting the discharge characteristic of the ink that the ink in the nozzle dries up during the non-use of the recording apparatus.

The method of the present invention may comprise the electric power saving shifting step of shifting the electric power consuming mode of the control portion of the recording apparatus including a CPU from an ordinary electric power consuming mode to an electric power saving mode before the execution of the power source switching off step after the execution of the terminating operation step. Also, even if an error occurs during the execution of the terminating operation sequence, the electric power saving shifting step may be forcibly executed, or when, after the shift to the electric power saving mode, the remaining amount of a battery has become lower than a predetermined level, the power source switching off step may be forcibly executed. Further, even if an error occurs during the execution of the terminating operation sequence, the power source switching off step may be forcibly executed.

Also, the recording apparatus in which the recovery operation control is done by a method of controlling the recording operation of the recording apparatus according to the present invention may be one to be carried on an automobile.

DETAILED DESCRIPTION OF THE PREFERRED EMBODIMENTS

First Embodiment

State of Being Carried on a Vehicle

Figure 1:
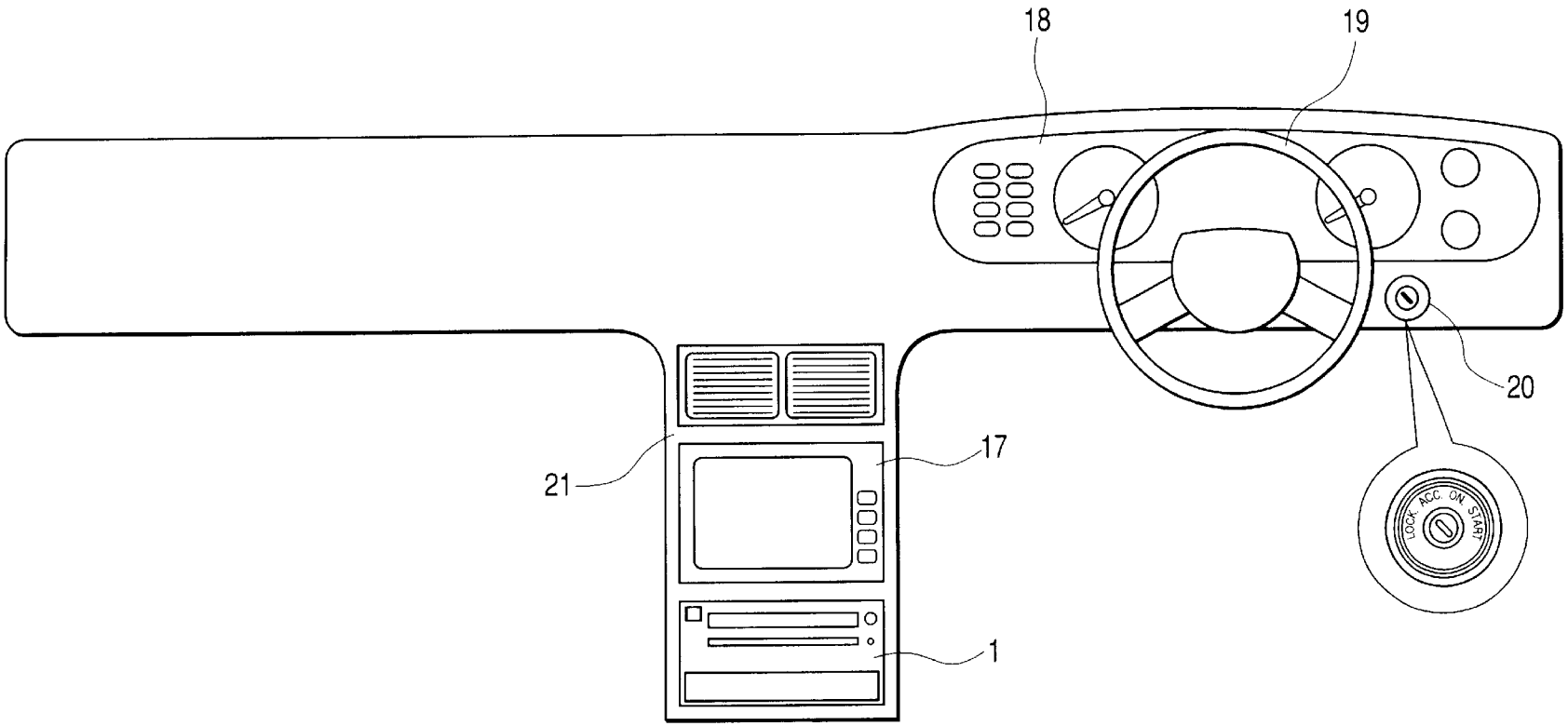
FIG. 1 is a schematic view showing the state of the surroundings of the dashboard of an automobile in which a recording apparatus according to a first embodiment of the present invention is installed.

FIG. 1 shows the state of the surroundings of the dashboard of an automobile in which a recording apparatus according to the present embodiment is installed.

The recording apparatus 1 is provided in a center console 21 located between the driver's seat in which a meter panel 18 and a steering wheel 19 are provided and the assistant driver's seat, and is electrically connected to a car PC 17 provided in the center console 21 with the recording apparatus 1 and having navigation (road guide) software and Internet connecting function or the like.

An ignition key switch 20 has four positions, i.e., LOCK position, ACC (accessory) position, ON position and START position, and is changed over by an ignition key being inserted into a keyhole and the ignition key being rotated, to thereby effect the switching on of the power source of the automobile and the starting of the engine of the automobile.

In the LOCK position, the taking out and putting in of the ignition key are possible, and the steering wheel 19 is locked to prevent stealing. In the ACC position, the radio, the can PC 17, etc. can be used even with the engine remaining stopped, but the charging of a battery is not effected because the engine is stopped. Therefore, if in this ACC position, electric power is consumed for a long time, the electric power of the battery will be used up in the worst case and the starting of the engine will become impossible. In the ON position, all electrical systems operate and the engine is rotating and therefore, the charging of the battery is done. In the START position, the engine is started. When the engine is started, the ignition key is released, whereby the ON position is automatically restored.

Whole of the Recording Apparatus

Figure 2:
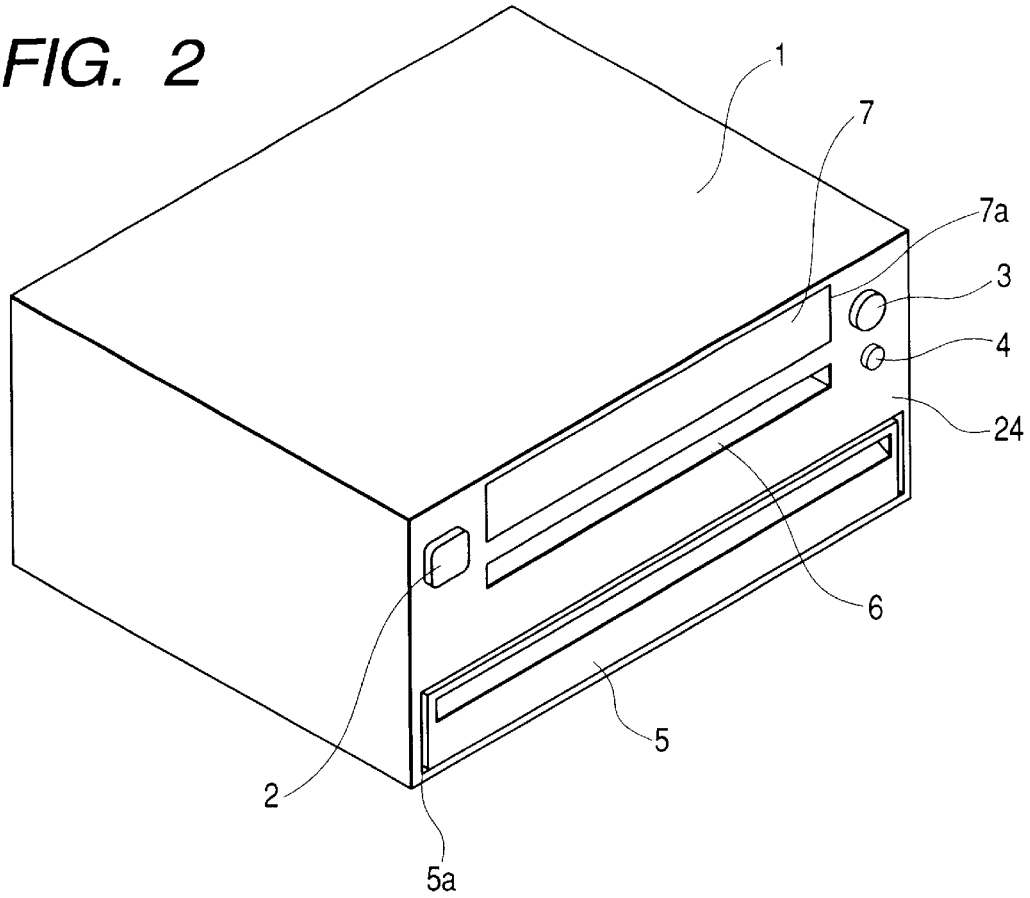
FIG. 2 is a perspective view of the recording apparatus according to the first embodiment of the present invention.

FIG. 2 is a perspective view of the recording apparatus 1 as it has been taken out of the center console 21.

On the front panel 24 of the recording apparatus 1, there are provided a power source switch 2 for effecting the ON/OFF of the power source of the recording apparatus 1, a reset switch 3 for effecting the resetting of the recording apparatus 1, and a recovery switch 4 for effecting the recovery operation of the head of the recording apparatus 1, and there are formed an ink cassette insertion port 7*a* for mounting an ink cassette 7 containing therein ink for effecting recording, a sheet feed cassette insertion port 5*a* for mounting a sheet feed cassette 5 containing recording mediums therein, and a sheet discharge port 6 for discharging therethrough the sheets after recording.

Figure 3:
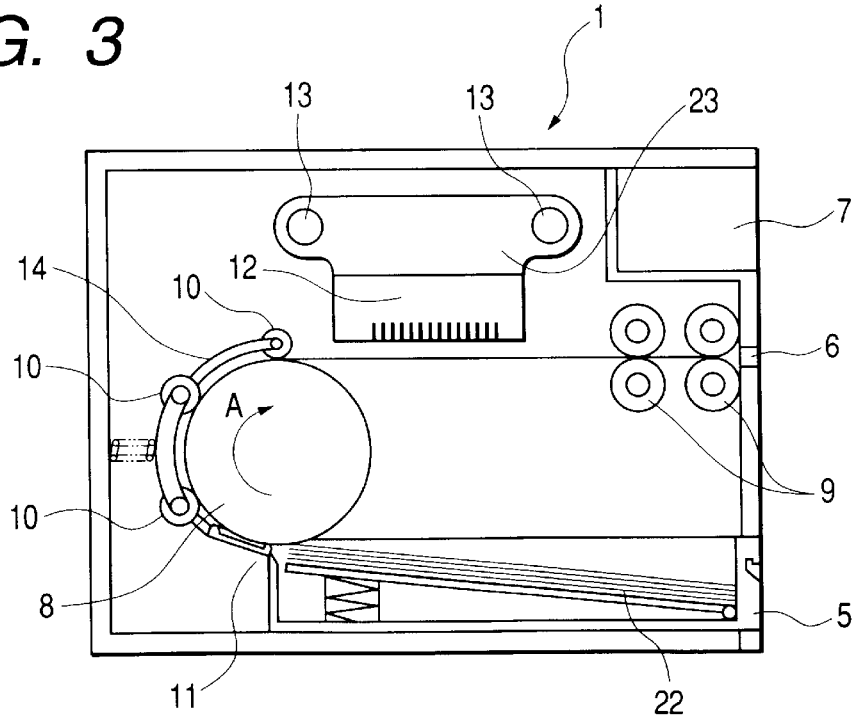
FIG. 3 is a schematic side cross-sectional view of the recording apparatus according to the first embodiment of the present invention.

FIG. 3 shows a schematic side cross-sectional view of the recording apparatus.

In the lower portion of the recording apparatus 1, there is disposed the sheet feed cassette 5 for holding recording sheets 22 stacked therein and supplying the recording sheets 22 which are recording mediums.

Also, the recording apparatus 1 has a conveying roller 8 for conveying the recording sheets 22 from the sheet feed cassette 5, a recording head 12 carried on a carriage 23 reciprocally movable in the main scanning direction parallel to the axis of a guide portion 14, and a pair of sheet discharge rollers 9 for nipping and discharging the recording sheets on which recording has been effected by the recording head 12 to the outside of the apparatus.

Conveying Portion

Separating means 11 is provided below the conveying roller 8, and the uppermost one of the recording sheets 22 stacked on the sheet feed cassette 5 is separated by this separating means 11. This separated recording sheet 22 is nipped by the conveying roller 8 rotatively driven in the direction of arrow A by a conveying motor 36 (see FIG. 7) and pinch rollers 10 and is guided by a guide member 14 provided on the outer periphery of the conveying roller 8, whereby the recording sheet 22 is conveyed in the subscanning direction which is a direction substantially perpendicular to the main scanning direction.

Recording Portion

As the recording head 12, use is made of an ink jet head for discharging ink through a discharge port by the utilization of film boiling created in the ink by heat energy applied by an electrothermal converting element. The supply of the ink to the recording head 12 is done from the ink cassette 7 by a tube, not shown. The tube is made of an elastic material such as silicone, and consideration is given so that it may not hinder the scanning of the recording head 12.

The ink cassette 7 may be one containing therein inks of three primary colors, i.e., yellow (Y), magenta (M) and cyan (C), or four colors including these three primary colors and black (K), and in this case, the carriage 23 may be one carrying thereon four kinds of recording heads 12 for discharging Y, M, C and K inks.

Description will hereinafter be made of the construction of the recording head 12 and the principle of ink jet recording.

Figure 4:
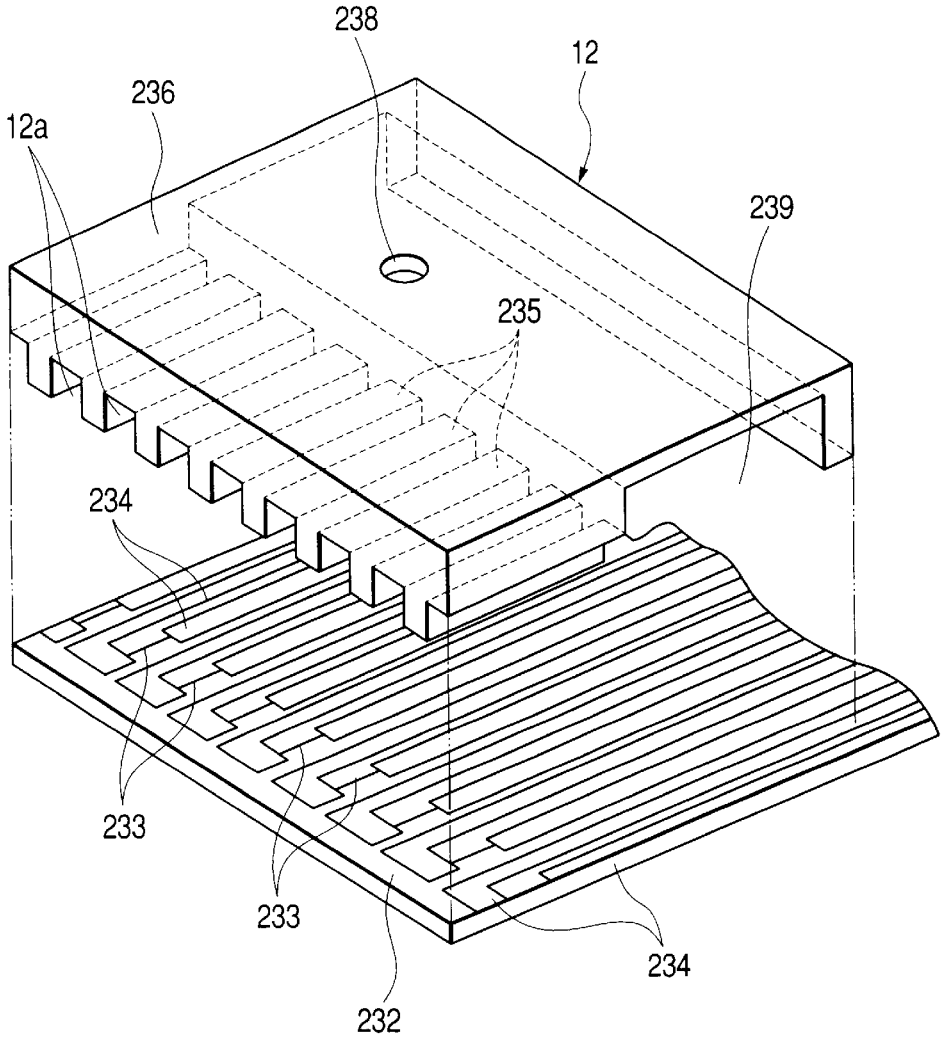
FIG. 4 is an illustration showing the construction of a recording head used in the recording apparatus according to the first embodiment of the present invention.

FIG. 4 is an illustration of the construction of the recording head which is the recording means of the recording apparatus of the ink jet type in the present embodiment, and FIGS. 5A to 5G are illustrations of the principle of bubble jet recording in the present embodiment.

On the heater board 232 of the recording head 12, electrothermal converting elements (discharge heaters) 233 and electrodes 234 of aluminum or the like for supplying electric power thereto are formed as film and disposed on a silicon substrate. Liquid paths 235 for recording liquid are formed by a top plate 236 having partition walls for partitioning the liquid paths 235 being adhesively secured to the heater board 232.

The ink supplied from the ink cassette 7 fills a common liquid chamber 239 in the recording head 12 from a supply port formed in the top plate 236, and is directed from this common liquid chamber 239 into the respective liquid paths 235. Discharge ports 12*a* are formed in these liquid paths 235, and the discharge ports 240 are formed at a predetermined pitch in the subscanning direction of the recording head 12 relative to the recording medium.

The principle of ink flying in the above-described bubble jet recording system will now be described with reference to FIGS. 5A to 5G.

Figure 5A:
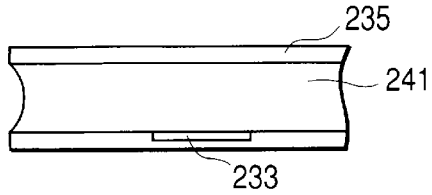
FIGS. 5A, 5B, 5C, 5D, 5E, 5F and 5G are illustrations of the principle of bubble jet recording in the recording head shown in FIG. 4.
Figure 5B:
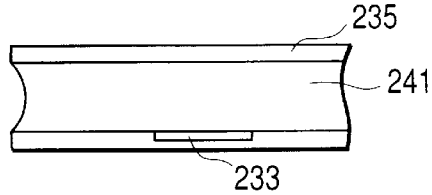
Figure 5C:
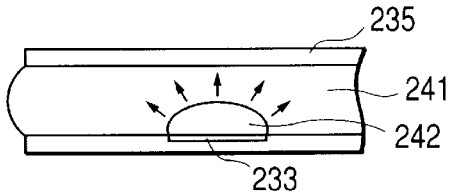

In a steady state, as shown in FIG. 5A, the ink 241 filling the liquid path 235 is balanced in surface tension and external pressure at the discharge port. When in this state, the ink 241 is to be ejected, electric power is supplied to the electrothermal converting element 233 in the liquid path 235 to thereby cause a rapid temperature rise to occur in the ink 241 in the liquid path 235 beyond nucleate boiling. Thereupon, as shown in FIG. 5B, the ink 241 adjacent to the electrothermal converting element 233 is heated and a minute bubble is created, the ink in the heated portion is gasified and film boiling occurs, and as shown in FIG. 5C, the bubble 242 grows rapidly.

Figure 5D:
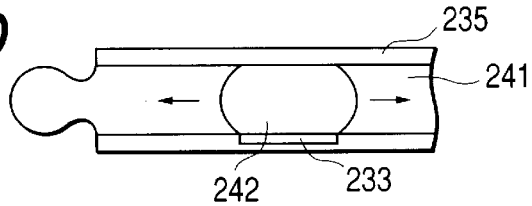
Figure 5E:
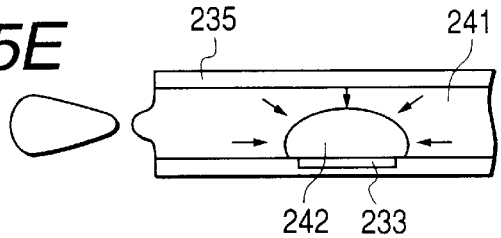
Figure 5F:
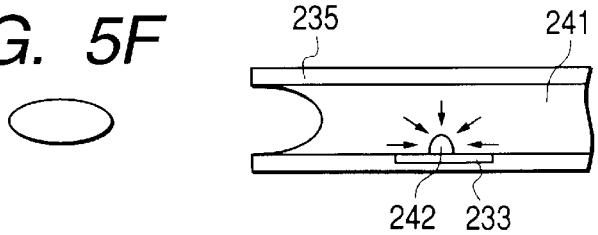
Figure 5G:
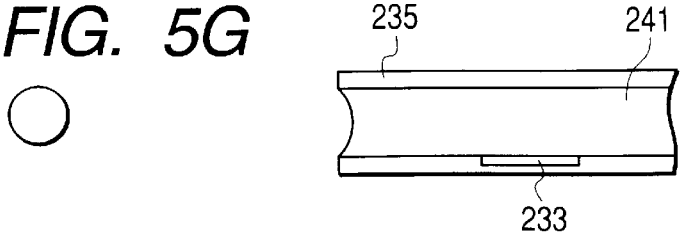

When the bubble 242 grows to its maximum as shown in FIG. 5D, an ink droplet is forced out of the discharge port in the liquid path 235, and at that speed the ink droplet flies to the recording medium and an ink image is recorded. When the supply of electric power to the electrothermal converting element 233 is terminated, the grown bubble 242 is cooled and constricted by the ink 241 in the liquid path 235, as shown in FIG. 5E, and further as shown in FIG. 5F, the ink contacts with the surface of the electrothermal converting element 233 and is suddenly cooled, and the bubble 242 disappears or is constricted to an almost negligible volume. When the bubble 242 is constricted, as shown in FIG. 5G, the ink is supplied from the common liquid chamber 239 into the liquid path 235 by a capillary phenomenon, and the electrothermal converting element is prepared for the next supply of electric power. Accordingly, by electric power being supplied to the electrothermal converting element 233 in synchronism with the main scanning of the carriage carrying the recording head thereon and in accordance with two signals, an ink image is recorded on the recording medium.

Sheet Discharging Portion

The pair of sheet discharge rollers 9 are provided downstream of the recording head 12 with respect to the subscanning direction which is the conveying direction of the recording sheet 22. The pair of sheet discharge rollers 9 are driven by a conveying motor 36 for driving the conveying roller 8, through drive transmitting means, not shown, and discharge the recording sheet 22 on which the recording by the recording head 12 has been effected from a sheet discharge port 6 to the outside of the recording apparatus.

Recovery Portion

Figure 6:
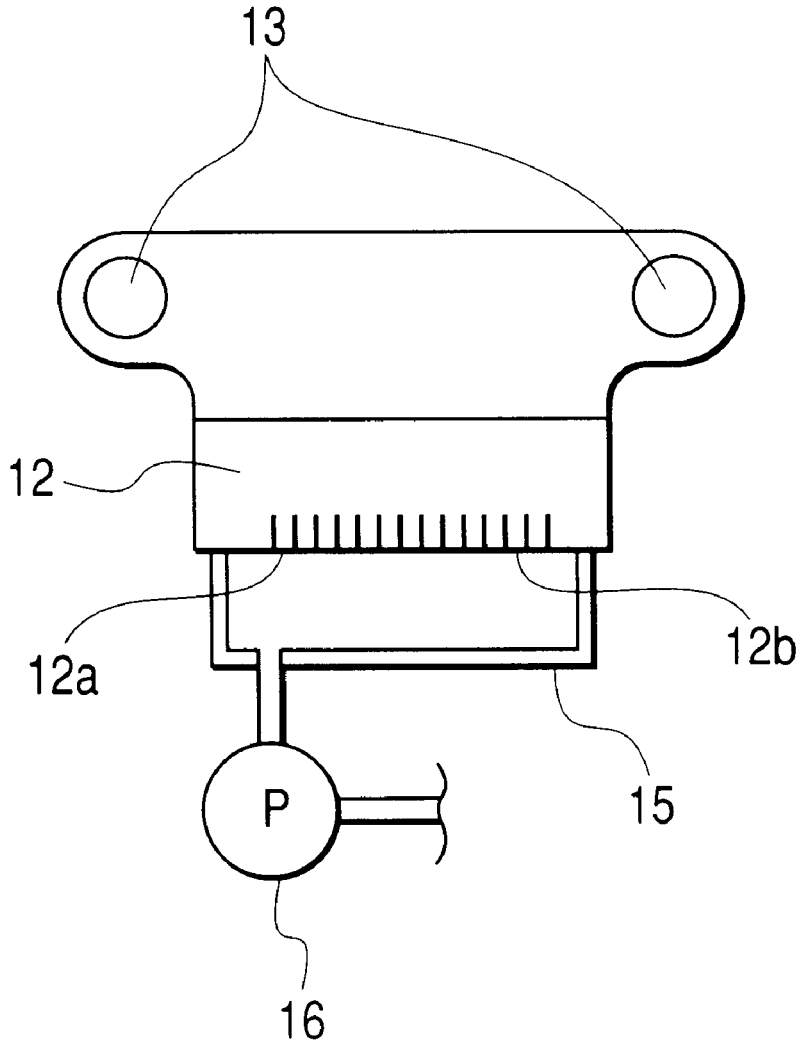
FIG. 6 is a schematic cross-sectional view of the recovery portion of the recording apparatus according to the first embodiment of the present invention.

In a portion of the carriage 23 in the scanning direction, there is a recovery portion which effects maintenance for recovering the discharging characteristic of the recording head 12. A schematic cross-sectional view of this recovery portion is shown in FIG. 6.

The recovering operation for the recording head 12 in the recovery portion is to hermetically seal a nozzle surface 12*b* formed with the discharge ports 12*a* for effecting the discharge of the ink, by a cap 15 made of an elastic material, and suck the ink by a suction pump 16 connected to the cap 15 to thereby eliminate the clogging or the like in the nozzle. In combination with a suction system shown in FIG. 6, a method of discharge-recovering the deteriorated ink in the nozzle into the cap, or the operation of giving the electrothermal converting elements electric power greater than usual and removing any stain on the electrothermal converting elements or the wiping operation by a wiping mechanism for wiping the nozzle surface 12*b* by an elastic material may be selectively executed.

Control Portion

Figure 7:
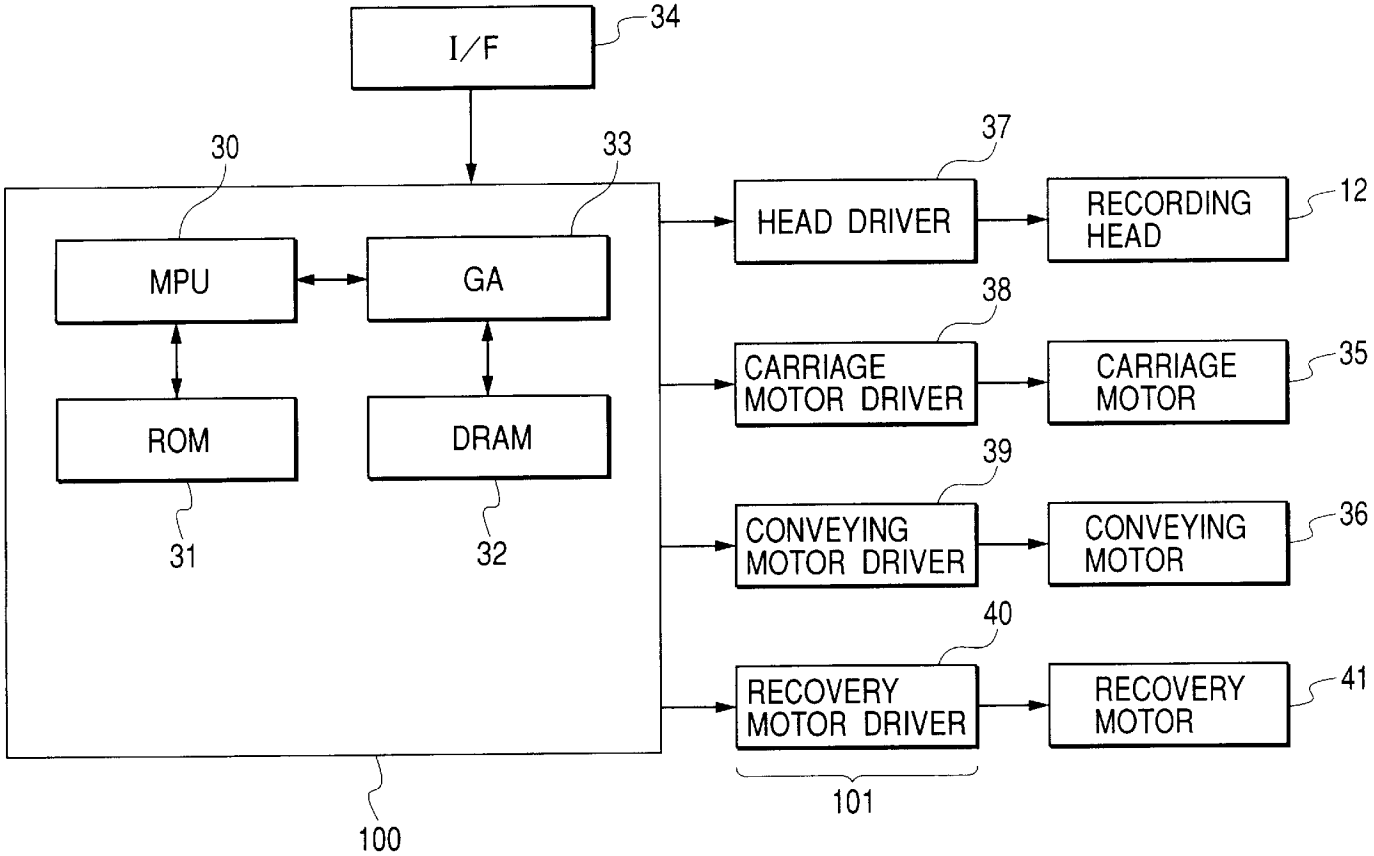
FIG. 7 is a block diagram of a control system for executing the recording control of the recording apparatus according to the first embodiment of the present invention.

A control system for executing the recording control of the recording apparatus according to the present embodiment will now be described with reference to the block diagram of FIG. 7.

A control portion 100 has a CPU 30, a ROM 31 storing therein a control program to be executed by the CPU 30, a dynamic type DRAM 32 storing therein various data such as a recording signal and recording data to be supplied to the recording head 12, and a gate array 33 for effecting the supply control of the recording data to the recording head 12, and the data transfer control among an interface 34 for inputting the recording signal, the CPU 30 and the DRAM 32.

A drive control portion 101 has a head driver 37 for driving the recording head 12, a carriage motor driver 38 for driving a carriage motor 35 for scanning the carriage 23 carrying the recording head 12 thereon, a conveying motor driver 39 for driving the conveying motor 36 for the conveying roller 8 and the pair of sheet discharge rollers 9, and a recovery motor driver 40 for driving the suction pump 16 for head recovery and a recovery motor 41 for various mechanisms for performing the capping operation by the cap 15.

The recording operation based on the above-described control construction will now be schematically described.

First, when the recording signal is inputted to the interface 34, the recording signal is converted into recording data for printing between the gate array 33 and the CPU 30.

Next, the recording sheet 22 is conveyed in the sub-scanning direction by the conveying motor 36 driven by the conveying motor driver 39 and also, the carriage 23 is scanned in the main scanning direction by the carriage motor 35 driven by the carriage motor driver 38. The recording head 12 carried on the carriage 23 is driven in accordance with the above-mentioned recording data sent to the head driver 37, and the ink supplied from the ink cassette 7 is discharged to the recording sheet 22 through the discharge ports 12*a* to thereby effect recording.

The recording sheet 22 on which recording has been effected is nipped by the pair of sheet discharge rollers 9 and is discharged from the sheet discharge port 6 to the outside of the recording apparatus 1.

Power Source System

Figure 8:
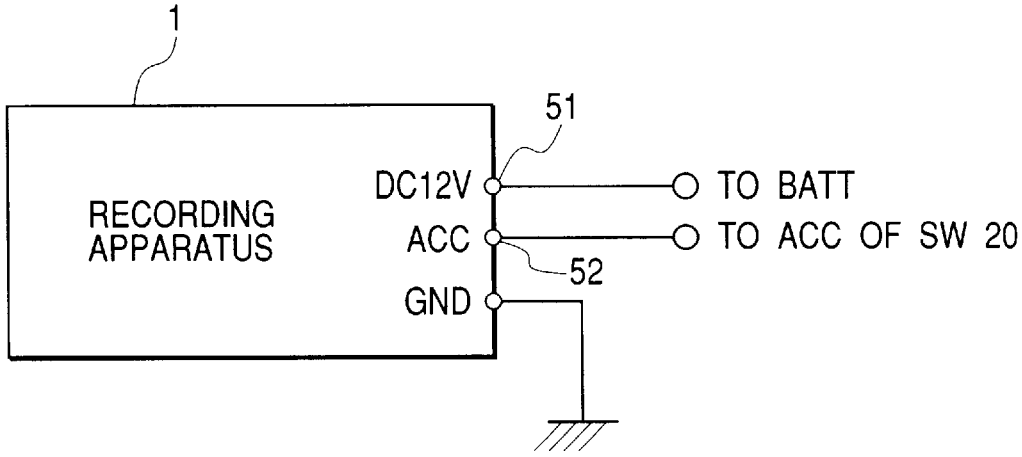
FIG. 8 shows a form of connection with the power sources in the recording apparatus according to the first embodiment of the present invention.

FIG. 8 shows a form of connection with the power sources in the recording apparatus 1 of the present embodiment.

The recording apparatus 1 has a first terminal 51 directly connected to the battery of the automobile which is a DC 12V power source, a second terminal 52 switched on and off by the ignition key switch 20, and a terminal connected to the ground which is the body of the automobile.

Terminating Process

Figure 9:
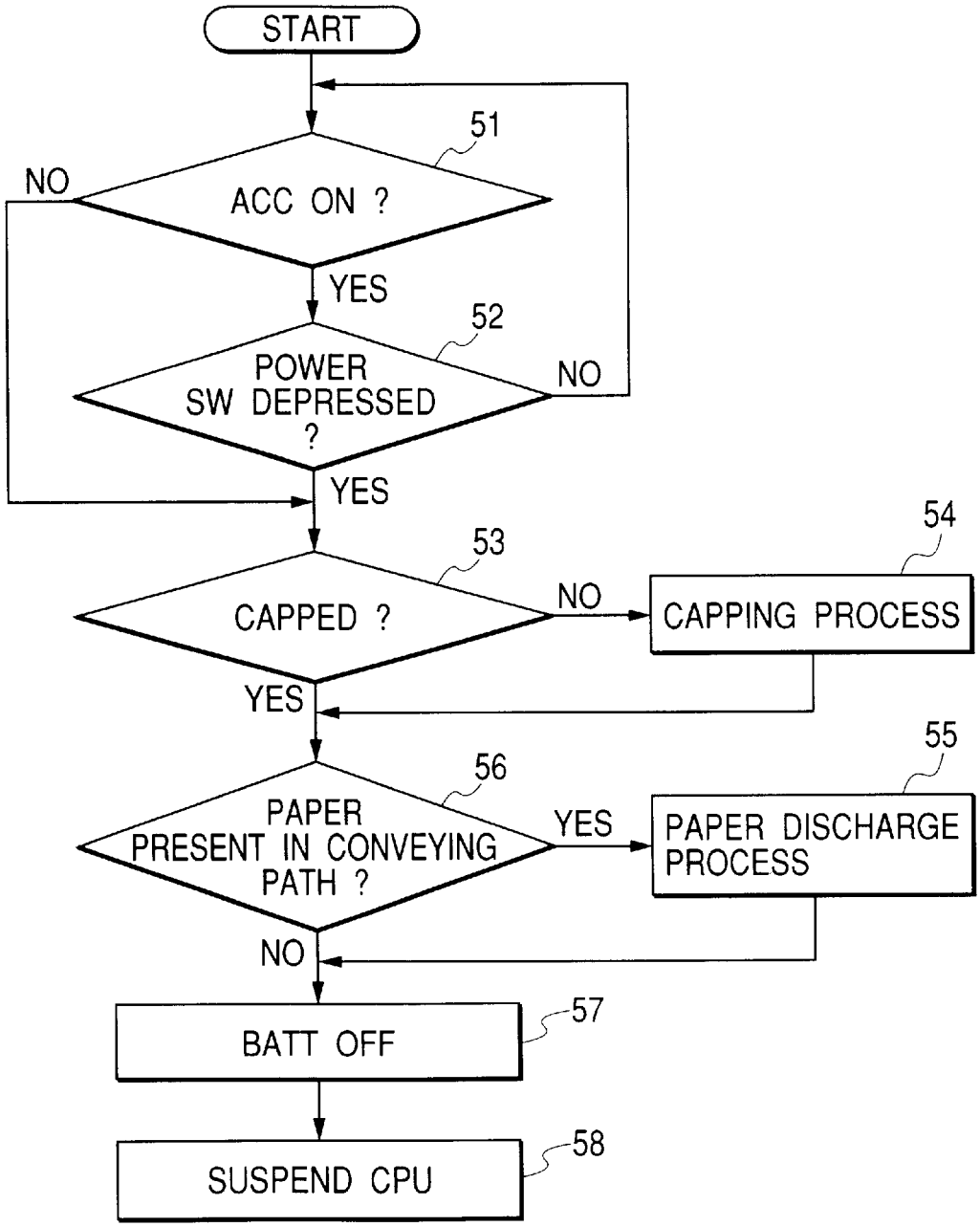
FIG. 9 is a flow chart regarding the terminating process of the recording apparatus according to the first embodiment of the present invention.

The operation of the terminating process of the recording apparatus will be described here with reference to the flow chart of FIG. 9.

First, whether the ignition key switch 20 is in the ACC position, that is, whether the ACC power source is ON, is judged (step 51). If the ACC power source is OFF and the electric power supply from the second terminal 52 is OFF, shift is made to a step 53. If the ACC power source is ON, whether the power source switch 2 of the recording apparatus 1 has been depressed to switch off the power source of the recording apparatus 1 is judged (step 52).

If the power source switch 2 is depressed, whether the recording head 12 is capped by the cap 15 is judged (step 53). It is not capped, shift is made to a step 54, where the capping process is carried out (step 54).

Next, whether the recording sheet 22 is present in the conveying path of the recording sheet 22 is judged (step 56). If the recording sheet 22 is present in the conveying path, the paper discharge process is forcibly carried out (step 55). This is because if an extreme change in temperature or humidity occurs with the recording sheet 22 being present in the conveying path, the recording sheet 22 may expand or contract and cause a jam. Particularly the temperature change of an automobile in its parking state is extreme and in some cases, a difference of 30° C. to 40° C. may occur between daytime and nighttime.

When the paper discharge process is terminated and the recording sheet 22 becomes absent in the recording apparatus 1, the connection between the first terminal 51 and the battery is cut off to thereby stop the electric power supply through the first terminal 51 (step 57), and then the CPU 30 is suspended (step 58).

At the above-described step 58, the CPU 30 may be shifted to the power saving mode and may be limited to the use of only slight electric power. In this case, it will be better if provision is made of means for monitoring the remaining amount in the battery, and completely shutting off the power source when the remaining amount reaches a predetermined amount or less.

As described above, according to the method of controlling the recording apparatus according to the present embodiment, even if the power source switch 2 of the recording apparatus 1 is not depressed and the ACC power source is switched off, the recording head 12 will be capped by the cap 15 and the discharge of the recording sheet 22 will be done without fail. Consequently, it becomes possible to always keep the recording apparatus 1 in a good state.

Second Embodiment

Figure 10:
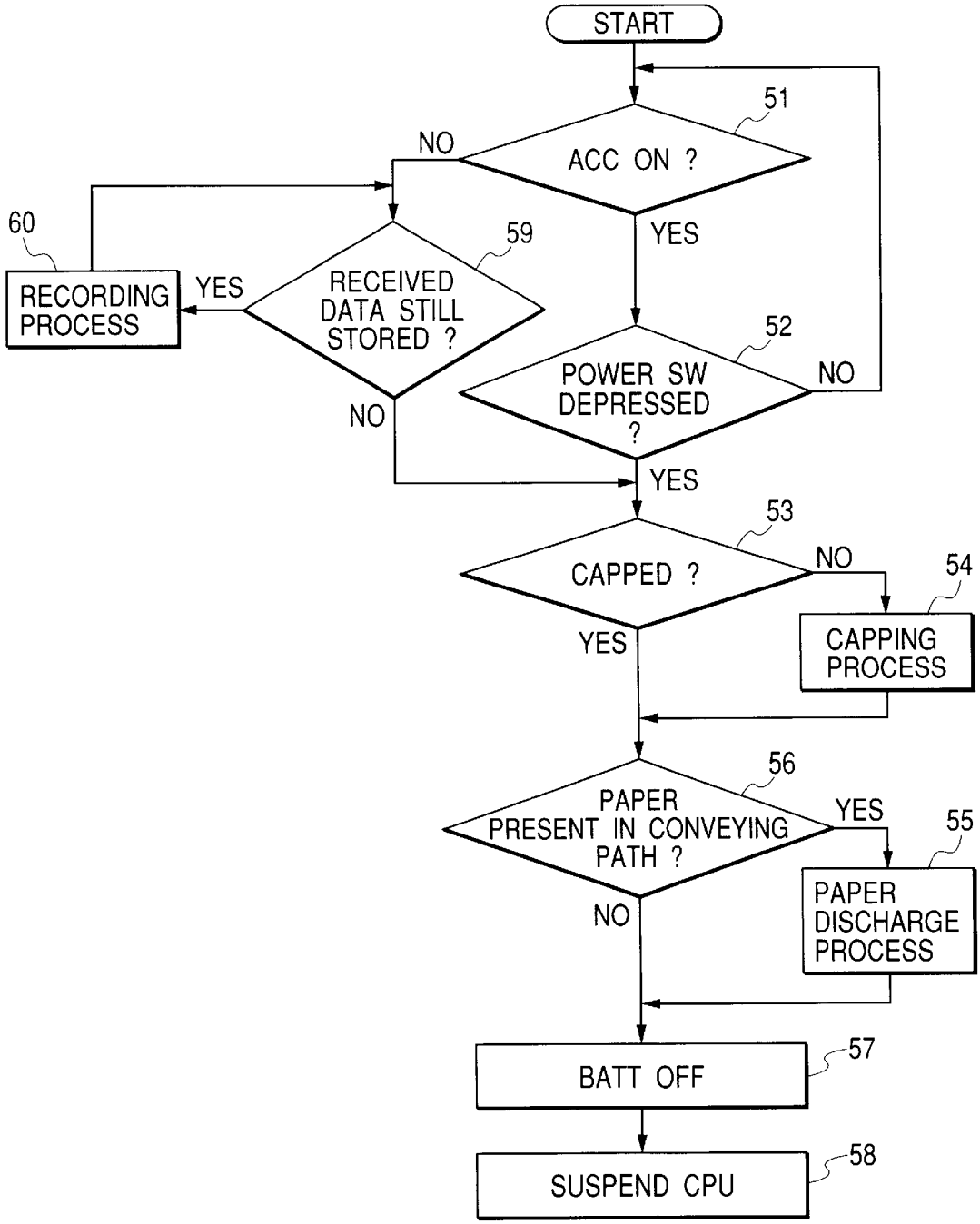
FIG. 10 is a flow chart regarding the terminating process of a recording apparatus according to a second embodiment of the present invention.

The operation of the terminating process of a recording apparatus according to a second embodiment of the present invention will hereinafter be described with reference to the flow chart of FIG. 10.

The construction and the basic portion of the terminating process in the recording apparatus according to the present embodiment are similar to those in the recording apparatus described in the first embodiment, and therefore need not be described in detail. Consequently, in the description of the present embodiment, the reference characters used in the first embodiment will be used and again in the flow chart of FIG. 10, the same step numbers are used for the same steps as those in the flow chart of FIG. 9.

In the terminating process of the present embodiment, at the step 51, whether the ignition key switch 20 is in the ACC position, that is, whether the ACC power source is switched on, is judged, and if the ACC power source is switched off and the electric power supply from the second terminal 52 is OFF, whether received data, i.e., recording data, is stored in DRAM 32 is first confirmed (step 59), the recording process corresponding in amount to the stored recording data is carried out (step 60), and then shift is made to the step 53. Thereafter, the electric power supply to the recording apparatus 1 is rendered OFF by the same step as in the first embodiment.

The recording speed of the recording apparatus 1 and the transfer speed of the recording data inputted from the interface 34 differ from each other in some cases, and in the serial type, the transfer speed of the recording data is often higher. The recording data at this time is stored in the DRAM 32 in the recording apparatus 1.

As described above, according to the method of controlling the recording apparatus according to the present embodiment, even if the ignition key is pulled out in the course of recording, the recording apparatus 1 is stopped after the recording of the recording data transferred from the car PC 17 has been completed and therefore, the recording error lessens. Also in the case of data which will require much time for recording, the user can pull out the ignition key and lock the door of the automobile and leave the place. Again in this case, the power source of the recording apparatus is automatically cut off upon completion of recording and therefore, it will never happen that the electric power of the battery is used up.

Again in the present embodiment, as in the first embodiment, even if the power source switch 2 of the recording apparatus 1 is not depressed but the ACC power source is switched off, the recording head 12 will be capped by the cap 15 and the discharge of the recording sheet 22 will be done without fail. Consequently, it becomes possible to always keep the recording apparatus 1 in a good state.

Third Embodiment

Figure 11:
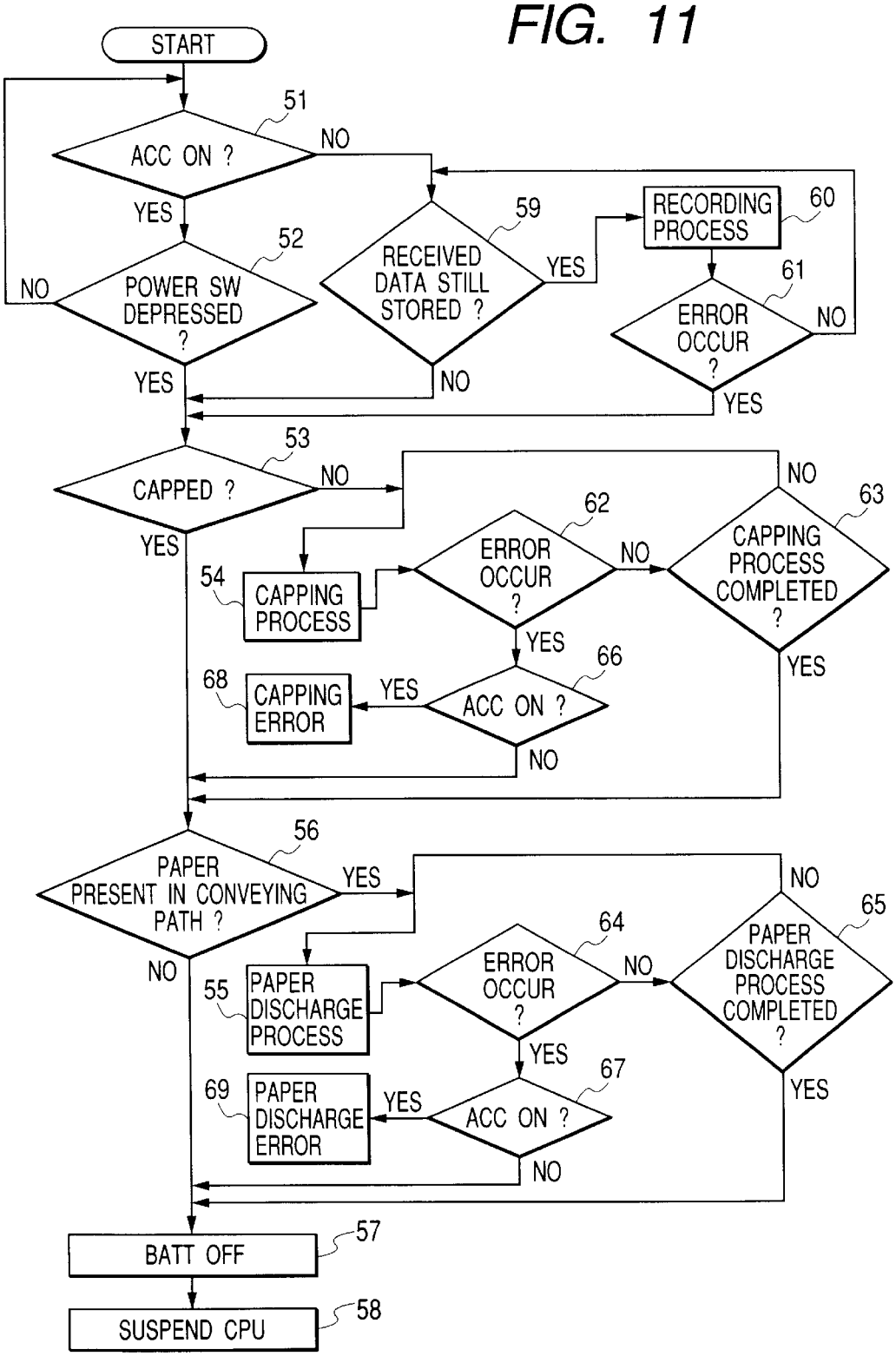
FIG. 11 is a flow chart regarding the terminating process of a recording apparatus according to a third embodiment of the present invention.

The operation of the terminating process of a recording apparatus according to a third embodiment of the present invention will hereinafter be described with reference to the flow chart of FIG. 11.

The construction and the basic portion of the terminating process in the recording apparatus according to the present embodiment are similar to those in the recording apparatuses described in the first and second embodiments, and therefore need not be described in detail. Consequently, in the description of the present embodiment, the reference characters used in the first and second embodiments will be used again in the flow chart of FIG. 11, that is, the same step numbers are used for the same steps as those in the flow charts of FIGS. 9 and 10.

The terminating process of the present embodiment is characterized in that the error checking step is further added to each of the recording process of the step 60, the capping process of the step 54 and the paper discharge process of the step 55.

The error checking step for the recording process of the step 60 will first be described.

The presence or absence of such error as a state in which the recording process has been carried out at the step 60 and the ink in the ink cassette 7 has become exhausted, whereby the ink supply to the recording head 12 has become null and recording has become impossible or a state in which the recording sheets have become exhausted and recording has become impossible, is judged (step 61), and if the error has occurred, shift is made to the step 53, where a process whereby the electric power supply to the recording apparatus 1 is forcibly rendered off is put forward.

Description will now be made of the error checking step for the capping process of the step 54.

At the step 54, the capping process is carried out, and whether the capping process is being carried out without any error is judged (step 62), and if the capping process is being carried out without any error, whether the capping process has been terminated is judged (step 63). If the capping process has been terminated, shift is made to the step 56, where a process whereby the electric power supply to the recording apparatus 1 is forcibly rendered OFF is put forward.

If at the step 62, an error occurs during the capping process, whether the ignition key switch 20 is in the ACC position, that is, whether the ACC power source is ON, is judged (step 66), and if the ACC power source is switched off and the electric power supply from the second terminal 52 is OFF, shift is made to a step 56, where a process whereby the electric power supply to the recording apparatus 1 becomes OFF is put forward. If the ACC power source is ON, a warning such as displaying a cap error on the meter panel 18 or buzzing in order to inform the user of the occurrence of the cap error is given (step 68).

Description will now be made of the error checking step for the paper discharge process of the step 55.

At the step 55, the paper discharge process is carried out, and whether the paper discharge process is being carried out without any error such as jam is judged (step 64), and if the paper discharge process is being carried out without any error, whether the paper discharge process has been terminated is then judged (step 65). If the paper discharge process has been terminated, shift is made to a step 56, where a process whereby the electric power supply to the recording apparatus 1 is forcibly rendered OFF is put forward.

If at the step 64, an error has occurred during the paper discharge process, whether the ignition key switch 20 is in the ACC position, that is, whether the ACC power source is switched on, is judged (step 67), and if the ACC power source is switched off and the electric power supply from the second terminal 52 is OFF, shift is made to a step 56, where a process whereby the electric power supply to the recording apparatus 1 becomes OFF is put forward. If the ACC power source is ON, a warning such as displaying a paper discharge error on the meter panel 18 or buzzing in order to inform the user of the occurrence of the paper discharge error is given (step 69).

As described above, according to the method of controlling the recording apparatus according to the present embodiment, it can be prevented that when the recording sheets 22 become exhausted or the ink becomes exhausted or an unexpected error such as jam occurs, the electric power is consumed in spite of the recording apparatus 1 being inoperable while being in an error state, whereby the electric power of the battery is used up.

Again in the present embodiment, as in the second embodiment, the recording apparatus 1 is stopped after the recording of the recording data has been completed and therefore, recording errors lessen and also, even in the case of data which will require much time for recording, the user can pull out the ignition key and lock the door of the automobile and leave the place. Again in this case, when recording is completed, the power source of the recording apparatus is automatically cut off and therefore, it will never happen that the electric power of the battery is used up.

Further, in the present embodiment, as in the first embodiment, even if the power source switch 2 of the recording apparatus 1 is not depressed and the ACC power source is switched off, the recording head 12 will be capped by the cap 15 and the discharge of the recording sheet 22 will be done without fail. Consequently, it becomes possible to always keep the recording apparatus 1 in a good state.

As described above, according to the present invention, the operation sequence of the recording apparatus is executed in accordance with the ON/OFF state of the second power input terminal and therefore, even when, for example, the user of the recording apparatus installed in the automobile forgets to switch off the power source switch of the main body of the recording apparatus and switches off only the ignition key, the operation sequence of maintaining the recording characteristic of the recording means, the operation sequence of terminating the operation of the recording apparatus, etc. can be executed in the OFF state of the ignition key. Thereby, the consumption of the battery carried on the automobile can be minimized.

Particularly in the case of a recording apparatus having ink jet recording means, the deterioration of performance due to an environmental change when the automobile is left unused can be prevented.

Further, the user can leave the automobile even when recording is not completed, and this can greatly contribute to the saving of time and an improvement in productivity.

What is claimed is:

1. A method of controlling a recording apparatus comprising recording means for effecting recording on a recording medium, and conveying means for conveying the recording medium, comprising:

an operation step of executing an operation sequence of said recording apparatus in accordance with the ON/OFF state of a power input terminal switched ON/OFF by the ignition key switch of an automobile;

a terminating operation step of executing a terminating operation sequence of recording as the operation sequence when electric power supply from the power input terminal has been switched OFF;

a power source switching off step of switching off the electric power supply from the power input terminal connected to a battery after the execution of the terminating operation sequence; and an electric power saving shifting step of shifting an electric power consuming mode of a control portion of said recording apparatus comprising a CPU from an ordinary electric power consuming mode to an electric power saving mode before execution of said power source switching off step after the execution of said terminating operation sequence.

2. A method according to claim 1, wherein ink is discharged from a nozzle to thereby effect recording.

3. A method according to claim 2, wherein said recording apparatus further comprises cap means for covering said nozzle of an ink jet recording means, and driving means for moving said cap means toward and away from said nozzle of said ink jet recording means, and the terminating operation sequence comprises a sequence of covering said nozzle of said ink jet recording means with said cap means.

4. A method according to claim 3, wherein even if an error occurs during the execution of said terminating operation sequence, said power source switching off step is forcibly executed.

5. A method according to claim 1, wherein even if an error occurs during the execution of said terminating operation sequence, said electric power saving shifting step is forcibly executed.

6. A method according to claim 1, wherein when a remaining amount in said battery assumes a predetermined level or less after the shift to the electric power saving mode, said power source switching off step is forcibly executed.

7. A method according to claim 1, wherein said recording apparatus is to be carried in a vehicle.

8. A recording apparatus including recording means for effecting recording on a recording medium, and conveying means for conveying the recording medium, said recording apparatus comprising:

a power input terminal adapted to be switched ON/OFF by an ignition key switch of an automobile; and control means for executing an operation sequence of said recording apparatus in accordance with an ON/OFF state of said power input terminal, said control means being operable in an electric power consuming mode, wherein said control means executes a terminating operation sequence of recording as the operation sequence when electric power supply from said power input terminal has been switched OFF, switches off the electric power supply from said power input terminal connected to a battery after the execution of the terminating operation sequence, and shifts the electric power consuming mode from an ordinary electric power consuming mode to an electric power saving mode before the electric power supply from switching off said power source after the execution of the terminating operation sequence.

9. A method of controlling a recording apparatus for effecting recording on a recording medium, comprising:

an operation step of executing an operation sequence of said recording apparatus in accordance with the ON/OFF state of a power input terminal switched ON/OFF by the ignition key switch of an automobile;

a determination step of determining whether a terminating operation sequence has ended in a case the power input terminal is in a switched-OFF condition; and a power source switching off step of switching off an electric power supply from a power source after execution of the terminating operation sequence, in a case the terminating operation sequence has been determined in said determination step not to have ended.

10. A method according to claim 9, wherein the terminating operation sequence comprises a sequence of capping a recording head.

11. A method according to claim 9, wherein the terminating operation sequence comprises a sequence of discharging a recording medium.

12. A method according to claim 9, wherein the switched-off condition of the power input terminal indicates that the ignition key is shifted from an "accessory (ACC)" position to an "OFF" position.

13. A method according to claim 9, wherein the power source is a battery of the automobile.

14. A recording apparatus for effecting recording on a recording medium, comprising:

a power input terminal adapted to be switched ON/OFF by an ignition key switch of an automobile; and control means for executing an operation sequence of said recording apparatus in accordance with the ON/OFF state of said power input terminal, wherein said control means determines whether a terminating operation sequence has ended in a case said power input terminal is in a switched-OFF condition, and said control means switches off an electric power supply from a power source after execution of the terminating operation sequence, in a case the terminating operation sequence has been determined not to have ended.

15. An apparatus according to claim 14, wherein the terminating operation comprises a sequence of capping a recording head.

16. An apparatus according to claim 14, wherein the terminating operation sequence comprises a sequence of discharging a recording medium.

17. An apparatus according to claim 14, wherein the switched-off condition of said power input terminal indicates that the ignition key is shifted from an "accessory (ACC)" position to an "OFF" position.

18. An apparatus according to claim 14, wherein said power source is a battery of an automobile.

* * * * *